US006762244B2

(12) United States Patent
Rajagopalan et al.

(10) Patent No.: US 6,762,244 B2
(45) Date of Patent: Jul. 13, 2004

(54) GOLF BALL CORE COMPOSITIONS CONTAINING HIGH VICAT SOFTENING THEMPERATURE, RESILIENT THERMOPLASTIC MATERIALS

(75) Inventors: Murali Rajagopalan, South Dartmouth, MA (US); Derek A. Ladd, Vista, CA (US)

(73) Assignee: Acushnet Company, Fairhaven, MA (US)

( * ) Notice: Subject to any disclaimer, the term of this patent is extended or adjusted under 35 U.S.C. 154(b) by 63 days.

(21) Appl. No.: 09/940,770

(22) Filed: Aug. 29, 2001

(65) Prior Publication Data

US 2002/0032278 A1 Mar. 14, 2002

Related U.S. Application Data

(63) Continuation-in-part of application No. 09/285,463, filed on Apr. 2, 1999, now Pat. No. 6,284,840.

(51) Int. Cl.[7] ..... A63B 37/06

(52) U.S. Cl. ..... 525/74; 525/92 A; 525/193; 525/274; 473/373; 473/374; 473/377

(58) Field of Search ..... 525/74, 92 A, 525/193, 274; 473/373, 374, 377

(56) References Cited

U.S. PATENT DOCUMENTS

| | | | | |
|---|---|---|---|---|
| 3,264,272 A | | 8/1966 | Rees | 260/78.5 |
| 3,534,965 A | | 10/1970 | Harrison | 273/218 |
| 3,883,145 A | | 5/1975 | Cox et al. | 273/218 |
| 4,337,946 A | | 7/1982 | Saito et al. | 273/225 |
| 4,919,434 A | | 4/1990 | Saito | 273/235 R |
| 4,972,020 A | | 11/1990 | Shiraki et al. | 525/90 |
| 5,093,423 A | | 3/1992 | Bayan et al. | 525/99 |
| 5,100,947 A | | 3/1992 | Puydak et al. | 524/423 |
| 5,270,386 A | | 12/1993 | Laughner | 525/66 |
| 5,334,673 A | | 8/1994 | Wu | 273/235 R |
| 5,368,304 A | | 11/1994 | Sullivan et al. | 273/220 |
| 5,439,227 A | | 8/1995 | Egashira et al. | 273/228 |
| 5,484,870 A | | 1/1996 | Wu | 528/28 |
| 5,688,191 A | | 11/1997 | Cavallaro et al. | 473/373 |
| 5,692,974 A | | 12/1997 | Wu et al. | 473/377 |
| 5,779,562 A | * | 7/1998 | Melvin | |
| 5,833,553 A | * | 11/1998 | Sullivan | |
| 5,885,172 A | | 3/1999 | Hebert et al. | 473/354 |
| 5,895,105 A | * | 4/1999 | Nesbitt | |
| 5,948,859 A | * | 9/1999 | Sano | |
| 6,093,357 A | | 7/2000 | Bissonnette et al. | 264/248 |
| 6,180,722 B1 | | 1/2001 | Dalton | 525/193 |
| 6,284,840 B1 | * | 9/2001 | Rajagopalan | |
| 6,431,999 B1 | * | 8/2002 | Nesbitt | |

FOREIGN PATENT DOCUMENTS

| | | |
|---|---|---|
| WO | WO 00 43077 | 7/2000 |

OTHER PUBLICATIONS

DuPont Hytrel Product and Properties Guide pp. 1–12.*
Encyclopedia of Polymer Science and Engineering vol. 12; pp. 417–419.*

* cited by examiner

*Primary Examiner*—David J. Buttner
(74) *Attorney, Agent, or Firm*—Swidler Berlin Shereff Friedman, LLP

(57) ABSTRACT

The invention is directed to golf ball core compositions comprising at least one natural or synthetic rubber and at least one high Vicat softening temperature thermoplastic material, methods of preparing the compositions, and golf ball cores and golf balls including the compositions. The compositions of the invention are made by mixing at least one natural or synthetic rubber and at least one thermoplastic or thermoplastic elastomer at a first temperature; cooling the mixture to a second temperature which is below an activation temperature of a free-radical initiator; adding the free-radical initiator to the first mixture to form a second mixture; and heating the second mixture to a third temperature that to facilitate crosslinking. The golf ball cores are incorporated into multilayer balls including dual cover balls with thin outer layers.

29 Claims, 1 Drawing Sheet

GOLF BALL CORE COMPOSITIONS CONTAINING HIGH VICAT SOFTENING THEMPERATURE, RESILIENT THERMOPLASTIC MATERIALS

CROSS REFERENCE TO RELATED APPLICATIONS

This application is a continuation-in-part of application Ser. No. 09/285,463, filed Apr. 2, 1999, now U.S. Pat. No. 6,284,840, the disclosure of which is incorporated by reference herein in its entirety.

FIELD OF INVENTION

The present invention is directed to golf balls and golf ball core compositions having good durability, high resilience, and including at least one high Vicat softening temperature thermoplastic material. The golf balls of the invention can have various layer constructions, e.g., multilayer cores, multilayer covers, multiple intermediate layers, etc. The invention also includes methods of forming such golf balls and portions thereof.

BACKGROUND OF THE INVENTION

Golf ball manufacturers are constantly attempting to construct golf balls having a desirable combination of good "feel," distance, and durability. One way in which the properties of a golf ball may be adjusted is through the cover composition and construction of the ball. Conventional golf balls can be divided into several general types or groups: (1) one piece balls; (2) two piece balls; (3) wound balls; and (4) other balls with three or more layers. The difference in play characteristics resulting from these different types of constructions can be quite significant.

Wound balls typically have either a solid rubber or fluid filled center around which many yards of a stretched elastic thread or yarn are wound. The wound core is then covered with a durable cover material, such as SURLYN®, or a softer material, such as balata or a castable polyurethane. Wound balls are generally softer and provide more spin than the aforementioned two piece balls. Particularly with approach shots into the green, the high spin rate of soft, wound balls enables the golfer to stop the ball very near its landing position.

Balls having a solid two piece construction are generally most popular with the average recreational golfer because they provide maximum distance and durability. Two piece balls commonly include a single solid core, usually formed of a crosslinked rubber. Solid cores are often made of polybutadiene that is chemically crosslinked with zinc diacrylate and/or similar crosslinking agents and is covered by a tough, cut-resistant blended cover, such as SURLYN®, an ionomer resin produced by E. I. Du Pont de Nemours & Co. of Wilmington, Del. The combination of the core and cover materials imparts a relatively high initial velocity to the ball resulting in improved distance. Due to the rigidity of these materials, two piece balls have a hard "feel" when struck with a club and a lower spin rate, making these balls more difficult to draw or fade.

A number of golf ball manufacturers have introduced golf balls having three or more layers in an effort to overcome the undesirable aspects of conventional two-piece balls, such as their hard feel, while retaining their positive attributes, such as increased initial velocity and distance. These balls have multiple core layers, i.e., they include a center with one or more intermediate layers, and one or more cover layers.

Although a variety of factors affect which of these types of balls a player will use, all players desire a ball that is affordable and durable. Therefore, in an effort to meet the demands of the marketplace, manufacturers strive to develop low-cost, efficient manufacturing techniques that produce golf balls which are resistant to cutting and cracking, yet which exhibit desirable distance, spin rate, and compression.

The durability of a ball depends not only upon its cover, but upon its core as well. A number of elastomers such as polybutadiene, natural rubber, styrene butadiene rubber, and isoprene rubber are commonly used in fabricating golf ball cores. Polybutadiene is most commonly used to obtain desired golf ball properties. Manufacturers have added cross-linking agents, such as metallic salts of an $\alpha,\beta$-unsaturated carboxylic acid, to the elastomeric core composition to achieve a desired resiliency, compression, and durability.

Some manufacturers have instead attempted to provided improved golf balls by surrounding polybutadiene solid centers with thermoplastic intermediate layers. For example, U.S. Pat. No. 4,337,946 discloses a golf ball having an intermediate layer of thermoplastic resin between a polybutadiene thread-wound center portion and an outer polyester elastomer cover layer which contributes to the ball's impact and cutting resistance characteristics.

U.S. Pat. No. 4,919,434 discloses a golf ball having a solid core of more than 40% cis-1,4-polybutadiene and a cover having an inner layer of 0.1 to 2 mm thickness and an outer layer of 0.1 to 1.5 mm thickness. The inner layer is a thermoplastic resin, such as an ionomer, polyester elastomer, polyamide elastomer, thermoplastic urethane elastomer, propylene-butadiene copolymer, 1,2-polybutadiene, polybutene-1, and styrene-butadiene block copolymer, either individually or in combination.

U.S. Pat. No. 5,439,227 discloses a three-part golf ball having a rubber inner core, and an outer core formed by injection molding a mixture of 100 to 50 weight percent of a polyether ester type thermoplastic elastomer and 0 to 50 weight percent of an ethylene-(meth)acrylate copolymer ionomer.

While materials incorporating a thermoplastic into a polymer blend are known, the use of such blends in portions of a golf ball core is not known. For example, U.S. Pat. No. 4,972,020 discloses an inner cover layer having a modified block copolymer of a thermoplastic polymer and a modified block copolymer consisting essentially of a base block copolymer of a monovinyl substituted aromatic hydrocarbon polymer block and an olefinic compound polymer block having an ethylenic unsaturation degree not exceeding 20 percent, wherein the base block has a molecular unit having a carboxylic acid group and/or a group derived therefrom grafted thereto.

U.S. Pat. No. 5,093,423 discloses a method of making a thermoplastic elastomer produced by dynamic vulcanization of styrene-butadiene-styrene ("SBR") rubber as a dispersed phase of crosslinked SBR, and a co-continuous matrix of styrene-ethylene-butylene-styrene ("SEBS") and polypropylene.

U.S. Pat. No. 5,100,947 discloses a dynamically vulcanized composition of a polyolefin thermoplastic resin and an elastomer of a rubber material in which a major portion of fillers or specified additives are present in the resin.

U.S. Pat. No. 5,270,386 discloses a cover blend of vinyl aromatic copolymer and a poly(phenylene ether) concentrate containing poly(phenylene ether), a vinyl aromatic copolymer, polyamide, polycarbonate, polyester, poly(alkyl acrylate), and/or poly(alkyl methacrylate). The blend may optionally contain impact modifiers, thermoplastic molding materials including polyester, polystyrene, polyolefin, polyamide, polyvinyl chloride, polyurethane, polyacetal, and conventional additives, such as dyes and pigments.

While some of the references discussed herein describe the use of thermoplastics in forming a golf ball cover, a golf ball core or portion of a core that contains a blend of both thermoplastic and elastomeric materials is not disclosed. There has thus been a long-felt need, which is now satisfied by the present invention, for a golf ball core, or portion thereof, having a blend of at least one high Vicat softening thermoplastic and at least one elastomer to provide an increased geometric stability without substantially affecting the desired golf ball properties.

SUMMARY OF THE INVENTION

The present invention is directed to golf ball core compositions, and methods for forming golf ball cores of the compositions, having at least one elastomer and at least one thermoplastic or thermoplastic elastomer dispersed therein. The thermoplastic or thermoplastic elastomer preferably has a high Vicat softening temperature and high resilience. At least a portion of the compositions are crosslinked. In one embodiment, the at least one thermoplastic or thermoplastic elastomer has a hardness of at least about 15 Shore A, a dynamic shear storage modulus of at least about $10^4$ dynes/$cm^2$, a loss tangent no greater than 1 at 23° C. and a frequency of 1 Hz, and a Vicat-softening temperature of at least about 38° C. The golf balls of the invention typically have an Atti compression no greater than about 110 and a coefficient of restitution of at least about 0.7 when fired at an inbound speed of 125 ft/sec with a cover having a thickness of at least about 0.03 inches, a cover hardness of at least about 40 Shore D, and at least about 60 percent dimple coverage. The cores formed from the composition typically have a Bashore rebound of at least about 30 percent and at least one inner layer having a compression no greater than about 110. The composition preferably includes a vulcanized material composition having at least one natural or synthetic rubber, a metal salt of unsaturated acid, an initiator, and at least one thermoplastic or thermoplastic elastomer; and optionally, a density-modifying filler. In a preferred embodiment, the golf ball includes at least one intermediate layer situated between the cover and the core, wherein the intermediate layer has a hardness of at least about 15 Shore A and a specific gravity of at least about 0.7, and is formed from a vulcanized material composition comprising at least one rubber, a metal salt of $\alpha,\beta$-unsaturated acid, an initiator, and at least one thermoplastic or thermoplastic elastomer having a hardness of at least about 15 Shore A, a dynamic storage modulus of at least about $10^4$ dynes/$cm^2$, a loss tangent no greater than 1 at 23° C. and a frequency of 1 Hz, and a Vicat-softening temperature of at least about 38° C.

The invention also encompasses golf balls including cores formed of the compositions disclosed herein. The cores can either be solid, fluid filled, or hollow, or they can contain two or more layers, i.e., any golf ball core construction may be used.

In one embodiment, the thermoplastic or thermoplastic elastomer has a Vicat-softening temperature of at least about 38° C. In a preferred embodiment, the thermoplastic or thermoplastic elastomer has a Vicat-softening temperature of at least about 50° C. In another embodiment, the thermoplastic or thermoplastic elastomer is substantially uniformly dispersed throughout the vulcanized material composition of the portion of the golf ball core.

In a further embodiment, the rubber component of the core is selected from the group of polybutadiene, polyisoprene, ethylene-propylene, styrene-butadiene, ethylene-propylene-diene rubber (EPDM), styrene-ethylene-butylene-styrene, and mixtures thereof, including functionalized derivatives thereof.

In another embodiment, the high Vicat-softening thermoplastic or thermoplastic elastomer of the golf ball core is a block polymer selected from the group of copoly(ether-ester), copoly(ether-amide), copoly(ester-amide), copoly (urethane-ether), copoly(urethane-ester), maleic anhydride grafted styrene-ethylene-butylene-styrene copolymers, and mixtures thereof.

In a further embodiment of the invention, the amount of thermoplastic or thermoplastic elastomer in the golf ball core is between about 1 to 50 parts per hundred of the total parts of the rubber, and more preferably between about 5 to 30 parts per hundred of the total parts of the rubber.

In another embodiment, the thermoplastic or thermoplastic elastomer has a Vicat softening temperature of from about 38° C. to 190° C. In a preferred embodiment, the Vicat softening temperature is from about 50° C. to 180° C., and in a more preferred embodiment from about 60° C. to 150° C.

In one embodiment of this invention, the thermoplastic or thermoplastic elastomer of the golf ball core has a Shore D hardness from about 20 to 75, more preferably 20 from about 25to 60.

In a preferred embodiment, the golf ball has a coefficient of restitution of greater than about 0.7. In a more preferred embodiment, the golf ball has a coefficient of restitution of greater than about 0.75. In a most preferred embodiment, the golf ball has a coefficient of restitution of greater than about 0.775.

In another embodiment, the thermoplastic or thermoplastic elastomer of the golf ball core has a flexural modulus from about 500 psi to 150,000 psi.

The golf ball core of this invention may further include, but is not limited to, an ingredient independently selected from the group of density-modifying fillers, foaming agents, metals, lubricants, colorants, antioxidants, and mixtures thereof. Several of these embodiments and preferred embodiments are also applicable to the method described below.

The present invention further encompasses a method of forming a portion of a golf ball core wherein a first mixture including at least one rubber and at least one thermoplastic or thermoplastic elastomer is mixed at a first temperature. The first mixture is then cooled to a second temperature which is below an activation temperature of a free-radical initiator capable of facilitating crosslinking of the first mixture. A second mixture is then created by combining the free-radical initiator and the first mixture and, if desired, further combining a crosslinking agent or other ingredients. The second mixture is then heated to a third temperature equal to or greater than the activation temperature of the free-radical initiator to cure the second mixture so as to form the portion of the golf ball core. The second temperature is typically above the first temperature and below the activation temperature of the free-radical initiator.

The method of the invention may further include selecting the crosslinking agent from the group of alpha- or beta-unsaturated carboxylic acids. In a preferred embodiment, the metal salts are selected from diacrylates, dimethacrylates, monomethacrylates, monoacrylates, and mixtures thereof.

The method may further include adding a free-radical initiator to the second mixture. This free-radical initiator is preferably selected from the group of dicumyl peroxide, 1,1-di(t-butylperoxy)-3,3,5-trimethyl cyclohexane, bis(t-butylperoxy)-diisopropylbenzene, 2,5-dimethyl-2,5 di(t-butylperoxy) hexane, di-t-amyl peroxide, di-t-butyl peroxide, and mixtures thereof.

In one embodiment, the first temperature is selected to be in the range from about 38° C. to 190° C., more preferably from about 50° C. to 180° C.

In another embodiment, the second temperature is selected to be in the range from about 16° C. to 80° C., more preferably from about 10° C. to 55° C.

The method of this invention may further comprise adding to the first mixture and/or the second mixture an ingredient independently selected from the group of density-modifying fillers, foaming agents, metals, lubricants, colorants, antioxidants, and mixtures thereof.

The method further includes forming a cover concentrically about the portion of the golf ball core so as to form a golf ball.

The present invention is also directed to a golf ball including a core, wherein the core comprises at least one layer formed of a composition including at least one rubber, a metal salt of an α,β-unsaturated acid, an initiator, and at least one thermoplastic material having a Vicat-softening temperature of at least about 38° C., an inner cover disposed about the core, and an outer cover disposed about the inner cover.

In one embodiment, the at least one thermoplastic material preferably has at least one of a hardness of at least about 15 Shore A, a dynamic storage modulus of at least about $10^4$ dynes/$cm^2$, or a loss tangent no greater than 1 at 23° C. and a frequency of 1 Hz.

The at least one thermoplastic material is preferably a thermoplastic elastomer. In one embodiment, the thermoplastic elastomer is a block polymer selected from the group consisting of a copoly(ether-ester), copoly(ether-amide), copoly(ester-amide), copoly(urethane-ether), copoly (urethane-ester), maleic anhydride grafted styrene-ethylene-butylene-styrene copolymers, and mixtures thereof.

The amount of said at least one thermoplastic material is preferably from about 1 to 50 parts per hundred of the total parts of the rubber. The at least one rubber is preferably selected from the group consisting of polybutadiene, polyisoprene, ethylene-propylene, styrene-butadiene, ethylene-propylene-diene rubber, a polymer of ethylene-propylene diene monomer, styrene-ethylene-butylene-styrene copolymer, and mixtures thereof, including functionalized derivatives thereof.

In one embodiment, the core has a diameter of about 1.55 inches or less.

In another embodiment, the outer cover comprises a castable reactive liquid material, preferably cast polyurethane. The outer cover preferably has a hardness from about 30 Shore D to about 60 Shore D and a thickness from about 0.02 inches to about 0.045 inches.

In yet another embodiment, the inner cover includes at least one material selected from the group consisting of ionomers, thermoplastic or thermoset polyurethanes, polyetheresters, polyetheramides, or polyesters, dynamically vulcanized elastomers, functionalized styrene-butadiene elastomers, metallocene polymers, polyamides such as nylons, acrylonitrile butadiene-styrene copolymers (ABS), and blends thereof. The inner cover preferably has a thickness from about 0.01 inches to about 0.05 inches and a hardness of about 65 Shore D or greater.

The present invention is also directed to a golf ball including a core including at least two layers, wherein at least one of the core layers is formed of a composition including at least one rubber, a metal salt of an α,β-unsaturated acid, an initiator, and at least one thermoplastic material, preferably a thermoplastic elastomer, having a Vicat-softening temperature of at least about 38° C., an inner cover disposed about the core, and an outer cover disposed about the inner cover.

The thermoplastic elastomer is preferably a block polymer selected from the group consisting of a copoly(ether-ester), copoly(ether-amide), copoly(ester-amide), copoly (urethane-ether), copoly(urethane-ester), maleic anhydride grafted styrene-ethylene-butylene-styrene copolymers, and mixtures thereof.

In one embodiment, the at least one thermoplastic material has at least one of a hardness of at least about 15 Shore A, a dynamic storage modulus of at least about $10^4$ dynes/$cm^2$, or a loss tangent no greater than 1 at 23° C. and a frequency of 1 Hz. The amount of the at least one thermoplastic material is preferably from about 1 to 50 parts per hundred of the total parts of the rubber.

In one embodiment, the at least one rubber is selected from the group consisting of polybutadiene, polyisoprene, ethylene-propylene, styrene-butadiene, ethylene-propylene-diene rubber, a polymer of ethylene-propylene diene monomer, styrene-ethylene -butylene-styrene copolymer, and mixtures thereof, including functionalized derivatives thereof.

In another embodiment, the core has a diameter of about 1.55 inches or less.

The outer cover preferably includes a castable reactive liquid material. In one embodiment, the castable reactive liquid material is cast polyurethane. The outer cover preferably has a hardness from about 30 Shore D to about 60 Shore D. In one embodiment, the outer cover has a thickness from about 0.02 inches to about 0.045 inches.

In one embodiment, the inner cover includes at least one material selected from the group consisting of ionomers, thermoplastic or thermoset polyurethanes, polyetheresters, polyetheramides, or polyesters, dynamically vulcanized elastomers, functionalized styrene-butadiene elastomers, metallocene polymers, polyamides such as nylons, acrylonitrile butadiene-styrene copolymers (ABS), and blends thereof. In another embodiment, the inner cover has at least one of a hardness of about 65 Shore D or greater. In yet another embodiment, the inner cover has a thickness from about 0.01 inches to about 0.05 inches.

The present invention is further directed to a method of forming a golf ball including the steps of: forming a first mixture including at least one rubber and at least one thermoplastic material; mixing said first mixture at a first temperature sufficient to allow substantially homogeneous mixing of said first mixture; cooling said first mixture to a second temperature, wherein said second temperature is below an activation temperature of a free-radical initiator capable of facilitating crosslinking of the first mixture; forming a second mixture by adding the first mixture to the free-radical initiator having the activation temperature at a temperature above the second temperature; and shaping and heating the second mixture to at least the activation temperature to crosslink the second mixture so as to form a portion of a golf ball core; forming an inner cover disposed about the golf ball core; and forming an outer cover thereon. The at least one thermoplastic material preferably includes a thermoplastic elastomer.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

Figure 1:
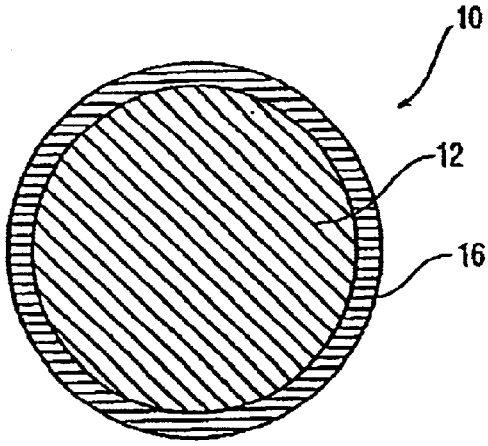
FIG. 1 illustrates a two-layer golf ball according to the present invention.

The present invention is particularly directed towards golf ball core compositions including a natural or synthetic rubber, a thermoplastic, and at least one additional ingredient selected from crosslinking agents, free-radical initiators, fillers, lubricants and colorants. The present invention is further directed to methods of making such golf ball core compositions. The present invention is also directed to such golf ball core compositions housed in a multilayer shell, e.g., inner and outer cover layers, and, optionally, at least one intermediate layer.

Core Layer(s)

It has now been found that the addition of various types and amounts of thermoplastics to golf ball core compositions, such as the thermoplastic compositions described herein, advantageously provide improved properties to the resultant golf balls. In particular, the addition of certain thermoplastics as described herein, in an amount of between about 1 to about 50 parts per hundred of the rubber ("phr"), more preferably about 5 to about 30 phr of the rubber, has been found to significantly increase the durability of the finished golf ball. As used herein in connection with ranges of numbers, the term "about" should be understood to refer to all numbers in the range. Addition of the thermoplastic(s) also increases the stiffness of the outer core, which allows for easier core molding.

As used herein, the term "golf ball core" means any portion of a golf ball contained within the cover. In the case of a golf ball having three or more layers, the term "golf ball core" includes at least one layer and typically refers to a center and at least one intermediate layer, also known as a "dual core" golf ball. The center may be solid, hollow, or fluid filled. The term "inner core layer" may be used interchangeably with "center" or "golf ball center", while the term "outer core layer" may be used interchangeably with "intermediate layer" or "at least one intermediate layer." For example, one optional type of intermediate layer is a tensioned elastomeric material wound about the center. When a tensioned elastomeric material is included as an intermediate layer, the compositions of the invention are preferably included in the elastomeric material, the center, or both.

As used herein, "thermoplastic(s)" may be used to mean thermoplastic(s) and/or thermoplastic elastomer(s). The thermoplastic portion is dispersed, preferably substantially uniformly dispersed, in the rubber formulation to provide uniform properties across the portion of the golf ball core. As used herein, the term "rubber" encompasses both natural and synthetic rubbers, and mixtures thereof. The mechanical properties of thermoplastics may be characterized in a number of ways, such as by the temperatures at which they deform under particular conditions.

Thermoplastic elastomers ("TPEs") typically possess physical properties characteristic of elastomers. For example, a load may be applied to a sheet made of a given thermoplastic and the sheet may be heated to a given temperature. This temperature is varied until the temperature at which the sheet is deflected by an established amount is determined. This temperature is known as the deflection temperature (see, e.g., ASTM Publication D 648-82 (Reapproved 1988).

A specific type of deflection-based test used to characterize thermoplastics is the Vicat softening test (see, e.g., ASTM Publication D 1525-91). This test determines the temperature at which a flat-ended needle of 1 $mm^2$ circular cross-section will penetrate a thermoplastic specimen to a depth of 1 mm under a load of 1 kg using a selected uniform rate of temperature rise (typically 50±5° C./h (Rate A) or 120±12° C./h (Rate B)). The temperature at which this penetration occurs is known as the Vicat softening temperature. Examples of Vicat softening temperatures include 72° C. for ethylene vinyl acetate, 97° C. for polystyrene, 128° C. for high density polyethylene, 153° C. for polypropylene, and 261° C. for Nylon 66. As used herein, the term "high Vicat softening temperature" typically refers to a Vicat softening temperature greater than about 38° C.

In one preferred embodiment, the thermoplastics used have high Vicat softening temperatures. A wide variety of thermoplastics have such Vicat softening temperatures. Preferably, the Vicat softening temperature is greater than about 50° C., and more preferably a temperature greater than about 60° C.

Thermoplastic elastomers suitable for use in the present invention generally include at least two polymer types or phases, each of which has a characteristic softening temperature. The preferred high Vicat softening temperature TPEs of this invention include the following categories: (1) block copoly(ester) copolymers (2) block copoly(amide) copolymers (3) block copoly(urethane) copolymers, (4) styrene-based block copolymers, and (5) thermoplastic and elastomer or rubber blends wherein the elastomer is dynamically vulcanized (hereafter "TEDV").

Preferably, the block copoly(ester) copolymer TPE is a block copoly(ester-ester), a block copoly(ester-ether), or mixtures thereof. More preferably, the block copoly(ester) copolymer TPE is at least one block copoly(ester-ether) or mixtures thereof. Suitable commercially available TPE copoly(ester-ethers) include the HYTREL® series from E. I. Du Pont de Nemours & Co. of Wilmington, Del. which includes HYTREL® 3078, G3548W, 4056, G4078W and 6356; ARNITEL® from DSM of Leominster, Mass.; ECDEL® from Eastman Kodak of Rochester, N.Y.; and RITEFLEX® from Hoechst Celanese of Dallas, Tex.

Preferably, the block copoly(amide) copolymer TPE is a block copoly(amide-ester), a block copoly(amide-ether), or mixtures thereof. More preferably, the block copoly(amide) copolymer TPE is at least one block copoly(amide-ether) or mixtures thereof. Suitable commercially available thermoplastic copoly(amide-ethers) include the PEBAX® series from Elf-Atochem of Philadelphia, Pa. which includes PEBAX® 2533, 3533, 4033 and 6333; the GRILAMID® series by Emser Industries of Sumpter, S.C., which includes Ely 60; and VESTAMID® and VESTENAMER® by Hüls America of Newport Beach, Calif.

Block copoly(urethane) copolymer TPEs comprise alternating blocks of a polyurethane oligomer (material with the higher softening point) and another block with a lower softening point. The polyurethane block comprises a diisocyanate, typically 4,4'-diphenylmethane diisocyanate, 4,4'-dicyclohexylmethane diisocyanate, 2,4-toluene diisocyanate, 2,6-toluene diisocyanate, para-phenylene diisocyanate or mixtures thereof, chains extended with a diol such as 1,4-butanediol, a dithiol such as 1,4-butanedithiol, a thio-substituted alcohol, such as 1-thiolbutane-4-ol, or mixtures thereof. Optionally, the block copoly(urethane) copolymer can be at least partially comprised of at least one dithioisocyanate.

Preferably, the block copoly(urethane) copolymer TPE is a block copoly(urethane-ester), a block copoly(urethane-ether), or mixtures thereof. Examples of suitable commercially available thermoplastic polyurethanes include the ESTANE® series from the B. F. Goodrich Company of Cleveland, Ohio, which includes ESTANE® 58133, 58134, 58144 and 58311; the PELLETHANE® series from Dow Chemical of Midland, Mich., which includes PELLETHANE® 2102-90A and 2103-70A; ELASTOLLAN® from BASF of Budd Lake, N.J.; DESMOPAN® and TEXIN® from Bayer of Pittsburgh, Pa.; and Q-THANE® from Morton International of Chicago, Ill.

Block polystyrene TPEs comprise blocks of polystyrene or substituted polystyrene, e.g., poly(α-methyl styrene) or poly(4-methyl styrene) chemically linked or joined to the ends of lower softening point blocks of either a rubber with unsaturation or a saturated rubber. Unsaturated rubber types typically include butadiene, which forms styrene-butadiene-styrene ("SBS") block copolymers, or isoprene, which forms styrene-isoprene-styrene (hereafter "SIS") block copolymers. Examples of suitable commercially available thermoplastic SBS or SIS copolymers include the KRATON® D series from Shell Chemical of Plano, Tex., which includes KRATON® D2109, D5119 and D5298; VECTOR® from Dexco of Plaquemine, La.; and FINAPRENE® from Fina Oil and Chemical of Plano, Tex.

Alternatively, the polystyrene blocks of polystyrene TPEs are joined to the ends of substantially saturated rubber blocks. Saturated rubber types typically include butyl rubber or hydrogenated butadiene. The latter styrene-(hydrogenated butadiene)-styrene TPEs, wherein the degree of hydrogenation may be partial or substantially complete, are also known as SEBS. Examples of suitable commercially available thermoplastic SEBS copolymers include the KRATON® G series from Shell Chemical, which includes KRATON® G2705, G7702, G7715 and G7720; SEPTON® from Kuraray of New York, N.Y.; and C-FLEX® from Concept Plastics of High Point, N.C.

Additionally, both hydrogenated and non-hydrogenated block polystyrene TPEs may be functionalized with polar moieties by performing maleic anhydride or sulfonic grafting. Examples of commercially available styrene-block elastomers functionalized by grafting include the KRATON® series from the Shell Corporation, which includes KRATON® FG1901X and FG1921X. Furthermore, block polystyrene TPEs may be functionalized with hydroxy substitution at the polymer chain ends. An example of a commercially available styrene-block elastomer functionalized by hydroxy termination is SEPTON® HG252 from the Mitsubishi Chemical Company of White Plains, N.Y.

Preferably, the block polystyrene TPE used in the golf ball cores of this invention comprises an unsaturated rubber, a functionalized substantially saturated rubber, or mixtures thereof. More preferably, the block polystyrene TPE comprises an unsaturated rubber functionalized by grafting with maleic anhydride, an unsaturated rubber functionalized by hydroxy termination, a substantially saturated rubber functionalized by grafting with maleic anhydride, a substantially saturated rubber functionalized by hydroxy termination, or mixtures thereof. Most preferably, the block polystyrene TPE comprises SBS or SIS functionalized by grafting with maleic anhydride, SEBS or SES functionalized by grafting with maleic anhydride, or mixtures thereof.

The second group of thermoplastic and elastomer blends, the TEDVs, are comprised of thermoplastic and elastomer or rubber blends wherein the elastomer is intentionally crosslinked or dynamically vulcanized. This terminology arises because in typical TEDV blending processes the elastomer phase is intentionally crosslinked or vulcanized while the melt is subjected to intense shearing fields during blending, in contrast to the quiescent conditions usually present when rubber is vulcanized. The softer or elastomeric polymer of a TEDV is usually natural, nitrile or butyl rubber or EPDM. Suitable TEDVs include SANTOPRENE®, VYRAM® and TREFSIN® from Advanced Elastomer Systems, which includes SANTOPRENE® 101-73 and 203-40 and TREFSIN® 3201-60; the SARLINK® 2000 and 3000 series from DSM of Leominster, Mass.; and TELPRENE® from Teknor Apex.

Although any thermoplastic, and in particular the six types of TPEs discussed above, may be incorporated into the compositions of the present invention, it is preferred that the thermoplastic component of this invention have a hardness of about 20 Shore D, or about 15 Shore A, preferably about 30 Shore A or greater, as measured by ASTM method D-2240. Preferably, the hardness is from about 20 to about 75 Shore D, more preferably from about 25 to about 60 Shore D.

It is further preferred that the thermoplastic component of this invention have a flexural modulus, as measured by ASTM method D-790, from about 500 psi to 150,000 psi, more preferably from about 1,000 psi to 70,000 psi. Finally, the Vicat softening temperature of the thermoplastic used in the present invention is preferred to be from about 38° C. to 190° C., more preferably from about 50° C. to 180° C., and most preferably from about 60° C. to 150° C. The thermoplastic or thermoplastic elastomer portion typically has a dynamic shear storage modulus of at least about $10^4$ dynes/cm$^2$, preferably from about $10^4$–$10^{10}$ dyn/cm$^2$, and more preferably from about $10^6$ to $10^8$ dyn/cm$^2$, when measured at 23° C. and a frequency of 1 Hz. The thermoplastic or thermoplastic elastomer also typically has a loss tangent no greater than 1, preferably from about 0.01 to 0.5 at 23° C., and more preferably from about 0.01 to 0.1 at 23° C.

The rubber component used in the methods and compositions of the present invention may be selected from the group of polybutadiene, polyisoprene, ethylene-propylene rubber, styrene-butadiene, styrene-propylene-diene rubber ("EPDM"), the polymer of ethylene-propylene diene monomer ("EPDM rubber"), and combinations thereof and the like. The rubber component is preferably polyisoprene or polybutadiene, more preferably polybutadiene, and most preferably a 1,4-cis-polybutadiene with a cis-1,4 content of above about 90 percent, more preferably above about 96 percent. An example of a suitable 1,4-cis-polybutadiene is Shell's CARIFLEX BR 1220, manufactured by Shell Chemical Co., and commercially available from H. Muehlstein & Co., Inc. of Norwalk, Conn. Other commercial sources of polybutadiene include NEOCIS BR40 manufactured by Enichem Elastomers of Baytown, Tex. and UBEPOL BR 150 manufactured by Ube Industries, Ltd. of New York, N.Y. If desired, the polybutadiene used in conventional compositions can be mixed with other elastomers known in the art, such as natural rubber, styrene butadiene rubber, and/or isoprene rubber in a manner known to those skilled in the art in order to further modify the properties of the core.

The polybutadiene or other rubber component may be produced with any suitable catalyst that results in a predominantly 1,4-cis content, and preferably with a catalyst that provides a high 1,4-cis content and a high molecular weight average. The rubber component of the present composition has a high molecular weight average, defined as being at least about 50,000 to 1,000,000, preferably from about 250,000 to 750,000, and more preferably from about 200,000 to 325,000 with reference to a known molecular weight polystyrene. CARIFLEX BR 1220 has a molecular weight average of about 220,000 with reference to a known molecular weight polystyrene. The 1,4-cis component of polybutadiene is generally the predominant portion of the rubber component when polybutadiene is present. "Predominant" or "predominantly" is used herein to mean greater than 50 percent of the polybutadiene. The 1,4-cis component is preferably greater than about 90 percent, and more preferably greater than about 95 percent, of the polybutadiene component.

The golf ball cores of the present invention can include additional ingredients including, but not limited to: crosslinking agents; free-radical initiators; metals and metal oxides; lubricants; colors; density-modifying fillers including ceramic, glass or plastic microspheres, and regrind (which is recycled core molding matrix ground to 50 mesh particle size); foaming and/or blowing agents; and other compounds and mixtures known to those skilled in the art.

Metal salts of alpha- and beta-unsaturated carboxylic acids, such as acrylic acid, methacrylic acid, or mixtures thereof, may be used as crosslinking agents. These include metal salts wherein the metal is magnesium, calcium, zinc, aluminum, sodium, lithium or nickel. Zinc diacrylate is often preferred because it has been found to provide golf balls with high initial velocities. Commercial zinc diacrylate is available in various grades of purity. Zinc diacrylate containing less than about 10 percent zinc stearate is typically preferable. More preferable is zinc diacrylate containing about 4 to 8 weight percent zinc stearate. Suitable, commercially available zinc diacrylates include those from Sartomer Co., Inc. of Exton, Pa. Zinc diacrylate is typically present in an amount from about 5 phr to 50 phr, preferably from about 20 phr to 50 phr, based upon 100 phr rubber.

During the production of the cores of this invention, free radical initiators are preferably used to promote crosslinking of the metal salts as described above and the polybutadiene. The free radical initiator may be any source of free radicals that facilitates crosslinking of monomers or polymers. Suitable examples include one or more peroxides, as well as electron beam, ultraviolet, gamma, x-rays, or any other high energy radiation source capable of generating free radicals. The free radical initiator is preferably a peroxide and more preferably an organic peroxide. When an organic peroxide is included in the free radical initiator, it is typically selected from dicumyl peroxide, 1,1-di(t-butylperoxy) 3,3, 5-trimethyl cyclohexane, $\alpha,\alpha'$-bis -(t-butylperoxy)-diisopropylbenzene, 2,5-dimethyl-2,5 di (t-butylperoxy) hexane, di-t-amyl peroxide, or di-t-butyl peroxide, di-(2-t-butylisopropylperoxy)-benzene, and mixtures thereof. Other useful initiators known to one of ordinary skill in the art may also be used. When one or more peroxide initiators are used, at 100 percent activity, they are typically added in an amount from about 0.05 phr to 2.5 phr based on the total elastomer weight, i.e., polybutadiene, or polybutadiene mixed with one or more other elastomers. Preferably, the amount of initiator is from about 0.15 phr to 2 phr and more preferably from about 0.25 phr to 1.5 phr.

The golf ball core compositions of this invention may also include fillers added to the elastomeric composition to adjust the density of the core. As used herein, the term "fillers" includes any reactive or inert compound or composition that can be used to vary the density and other properties of the subject golf ball core. The amount and type of filler used for golf balls that meet United States Golf Association ("USGA") standards is governed by the amount and weight of other ingredients in the composition, since a maximum golf ball weight of 1.620 ounces (45.92 gm) has been established by the USGA. Suitable fillers generally range in density from about 0.5 to about 20.

The core compositions may also include antioxidants that prevent the breakdown of the elastomer. Useful antioxidants include quinoline type antioxidants, amine type antioxidants, phenolic type antioxidants, and the like, and mixtures thereof.

Other ingredients such as accelerators, e.g., tetra methylthiuram, processing aids, processing oils, plasticizers, dyes and pigments, as well as other additives well known to the skilled artisan may also be used in the methods and core compositions of the present invention. Another suitable additive includes metals such as titanium, tungsten, bismuth, nickel, molybdenum, copper, zinc, cobalt and tin, and metal oxides thereof.

In one embodiment, the core has a diameter of about 1.55 inches or less. In another embodiment, the diameter of the core is from about 1.35 inches to about 1.55 inches.

Cover Layer(s)

Any conventional material may be used in preparing the golf ball cover layer(s) disposed about the core layer(s). As used herein, the term "golf ball cover" means a layer or portion covering the innermost components of the golf ball. In the case of a golf ball having three or more layers, the term "golf ball cover" may include at least one layer and typically refers to an inner and an outer cover, also known as a "dual cover" or "veneer" golf ball.

As is well known in the art, ionomers, balata, and urethanes are suitable golf ball cover materials. Other suitable cover materials include, but are not limited to thermoset materials as provided in U.S. Pat. Nos. 5,334,673 and 5,484,870, the entire disclosures of which are incorporated by reference herein, and thermoplastics such as ethylene- or propylene-based homopolymers and copolymers. These homopolymers and copolymers may also include repeat units of functional monomers such as acrylic and methacrylic acid, fully or partially neutralized ionomers and their blends, methyl acrylate, methyl methacrylate homopolymers and copolymers, imidized amino group-containing polymers, polycarbonate, reinforced polycarbonate, reinforced polyamides, poly(phenylene oxide), high impact polystyrene, poly(ether ketone), poly(sulfone), poly (phenylene sulfide), poly(acrylonitrile-butadiene-styrene), poly(ethylene terephthalate), poly(butylene terephthalate), poly(ethylene-vinyl alcohol), polyamids, poly (tetrafluoroethylene), and the like. Any of these polymers or copolymers may be further reinforced by blending with a wide range of fillers, including glass fibers or spheres, or wood pulp. The selection of a suitable cover material, and application thereof over the intermediate layer described herein, will be readily accomplished by those of ordinary skill in the art when considering the disclosure herein.

In one embodiment, a single cover layer is employed with a thickness of about 0.03 inches or greater and a hardness of about 40 Shore D or greater. In another embodiment, the cover layer has about 60 percent or greater dimple coverage. In another embodiment, the golf ball has a compression of about 120 or less.

Multiple cover layers may also be used with the golf ball of the present invention. When using an inner and outer cover layer construction, the outer cover layer material is preferably a thermoset material that includes at least one of a castable reactive liquid material and reaction products thereof. As used herein, the term "castable reactive liquid material" may refer to thermoset or thermoplastic materials. In a preferred embodiment, the castable reactive liquid material is a thermoset material. As used herein, the term "thermoset" refers to an irreversible, solid polymer that is the product of the reaction of two or more prepolymer precursor materials formed from a castable reactive liquid material.

In another preferred embodiment, the castable reactive liquid material is cast urethane or polyurethane. Polyurethane is a product of a reaction between a polyurethane prepolymer and a curing agent. The polyurethane prepolymer is a product formed by a reaction between a polyol and a diisocyanate. Often a catalyst is employed to promote the reaction between the curing agent and the polyurethane prepolymer. In the case of cast polyurethanes, the curing agent is typically either a diamine or glycol.

In another preferred embodiment, the castable reactive liquid material is a thermoset cast polyurethane. Thermoset cast polyurethanes are generally prepared using a diisocyanate, such as 2,4-toluene diisocyanate (TDI) or methylenebis-(4-cyclohexyl isocyanate) (HMDI) and a polyol which is cured with a polyamine, such as methylenedianiline (MDA), or a trifunctional glycol, such as trimethylol propane, or tetrafunctional glycol, such as N,N,N',N'-tetrakis(2-hydroxpropyl)ethylenediamine.

However, the present invention is not limited to just these specific types of thermoset cast polyurethanes. Quite to the contrary, any suitable cast or non-cast thermoset polyurethane may be employed to form outer cover layers of the present invention.

Other suitable thermoset materials contemplated for the outer cover layers include, but are not limited to, thermoset urethane ionomers and thermoset urethane epoxies. Examples of suitable thermoset polyurethane ionomers are disclosed in U.S. Pat. No. 5,692,974, which is incorporated in its entirety by reference herein.

The outer cover layer preferably has a hardness from about 30 Shore D to about 60 Shore D. In one embodiment, the outer cover layer is thin, preferably less than about 0.05 inches, and more preferably from about 0.02 inches to about 0.045 inches.

The inner cover layer may be formed from a wide variety of hard (about 65 ShoreD or greater, preferably from about 69 Shore D to about 74 Shore D), high flexural modulus resilient materials, which are compatible with the other materials used in the adjacent layers of the golf ball. The inner cover layer material preferably has a flexural modulus of about 65,000 psi or greater. In one embodiment, the flexural modulus of the inner cover layer material is from about 70,000 psi to about 120,000 psi. The inner cover layer preferably has a thickness from about 0.01 inches to about 0.05 inches. In another embodiment, the inner cover layer has a thickness of about 0.035 inches.

Suitable inner cover layer materials include the hard, high flexural modulus ionomer resins and blends thereof as disclosed in U.S. Pat. No. 5,885,172, which is incorporated in its entirety by reference herein. These ionomers are obtained by providing a cross metallic bond to polymers of monoolefin with at least one member selected from the group consisting of unsaturated mono- or di-carboxylic acids having 3 to 12 carbon atoms and esters thereof (the polymer contains 1 to 50% by weight of the unsaturated mono- or di-carboxylic acid and/or ester thereof). More particularly, such acid-containing ethylene copolymer ionomer component includes E/X/Y copolymers where E is ethylene, X is a softening comonomer such as acrylate or methacrylate present in 0–50 (preferably 0–25, most preferably 0–20), weight percent of the polymer, and Y is acrylic or methacrylic acid present in about 5–35 weight percent of the polymer, wherein the acid moiety is neutralized about 1–100% (preferably at least 40%, most preferably at least about 60%) to form an ionomer by a cation such as lithium*, sodium*, potassium, magnesium*, calcium, barium, lead, tin, zinc* or aluminum (*=preferred), or a combination of such cations. Specific acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers. The most preferred acid-containing ethylene copolymers are ethylene/methacrylic acid, ethylene/acrylic acid, ethylene/(meth)acrylic acid/n-butyl acrylate, ethylene/(meth)acrylic acid/ethyl acrylate, and ethylene/(meth)acrylic acid/methyl acrylate copolymers.

The manner in which the ionomers are made is well known in the art, as described in, e.g., U.S. Pat. No. 3,264,272, which is incorporated in its entirety by reference herein. Such ionomer resins are commercially available from DuPont under the tradename SURLYN® and from Exxon under the tradename lotek®. Some particularly suitable SURLYNS® include SURLYN® 8140 (Na) and SURLYN® 8546 (Li) which have an methacrylic acid content of about 19 percent.

Examples of other suitable inner cover materials include thermoplastic or thermoset polyurethanes, polyetheresters, polyetheramides, or polyesters, dynamically vulcanized elastomers, functionalized styrene-butadiene elastomers, metallocene polymers, polyamides such as nylons, acrylonitrile butadiene-styrene copolymers (ABS), or blends thereof. Other examples of suitable thermoset materials include polybutadiene, natural rubber, polyisoprene, styrene-butadiene, or styrene-propylene-diene rubber, which are particularly suitable when used in an inner layer of a golf ball. Suitable thermoplastic polyetheresters include materials which are commercially available from DuPont under the tradename Hytrel®. Suitable thermoplastic polyetheramides include materials which are available from Elf-Atochem under the tradename Pebax®.

Golf Ball Production

Conventional golf ball cores are typically produced by mixing their various components at temperatures of approximately 80° C. to form a composition that is then milled and hand prepped, or extruded, into pieces (known to those skilled in the art as "preps") suitable for molding. The preps are then compression molded into cores at a temperature high enough to initiate crosslinking of the composition. Compression molding is typically conducted at temperatures of from about 150° C. to 180° C. for about 10 to 30 minutes. Additional layers may optionally be added concentrically to form cores, or the cores can be used to make finished golf balls by providing cover materials concentrically thereon.

The method described above, however, is not suitable for the incorporation of high Vicat softening thermoplastics in a core composition, because the temperature at which the composition would be mixed is too low to allow adequate homogenation of the composition. Simply raising the temperature at which the composition is mixed, however, does not solve the problem because the free-radical initiators present in conventional core compositions are activated at the melting temperatures of these thermoplastics. This prevents adequate mixing of the thermoplastic, rubber, and other components of the core composition. It further prevents effective molding of the composition, since it will have hardened to a point not suitable for manipulation. These and other problems are solved by the present invention.

According to an embodiment of the present method, the desired thermoplastic or mixture of thermoplastics is heated to a temperature sufficient to soften it. The desired rubber or mixture or rubbers is then added to the softened thermoplastic, and the two are mixed until sufficient homogeneity is attained. If desired, the rubber(s) may be softened prior to addition, although this is generally not necessary. The resulting thermoplastic/rubber mixture is then cooled to a temperature at which the desired crosslinking agent and free-radical initiator will be substantially inactive. This temperature is dependent on the specific agent and initiator used, and is well known to those skilled in the art. Typically, the thermoplastic/rubber mixture is cooled to a temperature below about 80° C. Once the thermoplastic/rubber mixture has been cooled, the crosslinking agent and free-radical initiator are added.

Other ingredients, such as, but not limited to, fillers, lubricants and colorants, may also be added to the mixture at this time. These and other ingredients known to those skilled in the art may also be added to the softened thermoplastic before the rubber is added, during its addition, or anytime thereafter to form the core composition.

The resulting core composition may then be injection or compression molded during which time it is typically also heated to an activation temperature sufficient to facilitate crosslinking. The resulting inner layer, intermediate layer, or core may then be incorporated into a golf ball by conventional means.

In a second embodiment, the thermoplastic and rubber are combined prior to the initial heating and mixing. Other ingredients, except for the crosslinking agent and free-radical initiator, may then be added at any time. Again, the crosslinking agent and initiator are only added once the substantially homogeneous thermoplastic/rubber mixture is cooled to below the activation temperature of the free-radical initiator.

In a third embodiment, all the components of the core composition, except for the crosslinking agent and free-radical initiator, are combined prior to the initial heating and mixing. The crosslinking agent and initiator are then added once the substantially homogeneous mixture is cooled to below the activation temperature of the free-radical initiator.

The methods of the present invention may be conducted either by batch or continuous processes, and the core compositions and cores made therefrom may be used in conventional two-piece and wound golf balls as well as in multilayer golf balls. In fact, it is contemplated that the presently claimed cores and core compositions be employed in golf balls of any construction.

The golf balls of the present invention, or portions thereof, may be prepared using a variety of methods depending on the specific construction desired. For example, a solid spherical center is prepared from the core composition of this invention by at least one of conventional compression, injection molding, and/or winding techniques. A liquid-filled center may alternatively be formed instead of a solid center. Any additionally desired layers may then be formed by conventional compression or injection molding techniques, preferably in a concentric fashion to maintain a substantially spherical center.

If a multilayer ball is to be constructed, preforms may be prepared from the compositions of this invention as ellipsoidal or hemispherical half-shells using conventional compression or injection molding techniques. The preferred method is to prepare two ellipsoidal half-shells that fit around the center. The merged half-shells themselves would form an intermediate layer, but when the shells are properly disposed about a center and merged they form at least a portion of the core. More than one set of half-shells may be used to form additional intermediate layers as desired. U.S. Pat. No. 6,093,357 discloses the use of preforms and reinforcing polymers for use therein in preparing intermediate layers and golf ball cores, the entire disclosure of which is incorporated herein by reference.

In one embodiment, the golf ball is formed with a dual cover, as described above, wherein the inner cover layer is formed using injection molding and the outer cover layer is formed by casting a reactive liquid material. For example, the core of the golf ball may by a single layer or multiple layers, wherein at least one of the core layers is of the material of the present invention, the inner cover is then formed around the core layer(s) and may be made of ionomeric material, and the outer cover may be cast polyurethane.

The resulting golf ball preferably has an Atti compression of at least about 40, preferably from about 50 to 120, and more preferably from about 60 to 100. As used herein, the term "Atti compression" means the deflection of an object or material relative to the deflection of a calibrated spring, as measured with an Atti Compression Gauge, commercially available from Atti Engineering Corp. of Union City, N.J. Moreover, golf ball cores prepared according to the invention typically have a Bashore rebound of greater than about 30 percent, preferably from about 40 to 90 percent, and more preferably from about 50 to 75 percent and a coefficient of restitution of at least about 0.7, preferably of at least about 0.75, and more preferably of at least about 0.775 when fired at an inbound speed of 125 ft/sec.

The compositions of the present invention may be used in golf balls having a diameter of at least 1.68 inches, preferably from about 1.68 to 1.8 inches, and more referably from about 1.68 to 1.74 inches, to comply with the USGA rules of golf.

Specific Golf Ball Constructions

FIG. 1 illustrates a two-piece golf ball 10 of the invention having a core 12 formed from a composition of the invention, and a cover 16 disposed about the core.

Figure 2:
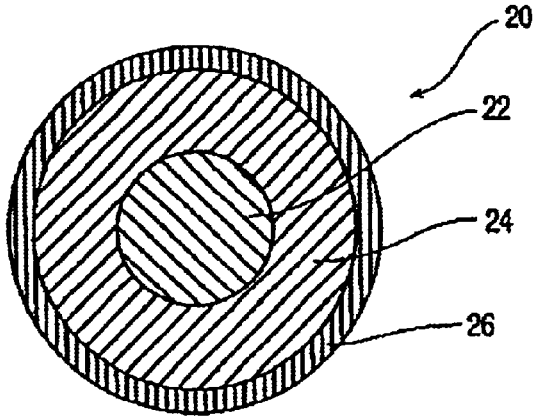
FIG. 2 illustrates a three-layer golf ball wherein the intermediate and/or center portion is formulated according to the present invention.

FIG. 2 illustrates a three-piece golf ball 20 of the invention. The center 22 is surrounded by one intermediate layer 24. A cover 26 is disposed about the intermediate layer 24. If desired, the center 22 and the intermediate layer 24 may both be made from the composition disclosed and taught herein, in which case, however, it is preferred that they not be made from exactly the same materials in the same ratios, i.e., each is made using a different thermoplastic, different rubber, or different thermoplastic:rubber ratio. It is preferred, however, that the intermediate layer 24 be formed from the composition of the invention while the center 22 is made from a conventional core composition, such as crosslinked polybutadiene. In one embodiment, the intermediate layer includes a tensioned elastomeric material wound about the center. In another embodiment, either in addition to or alternative to other embodiments, the center 22 includes a fluid.

Figure 3:
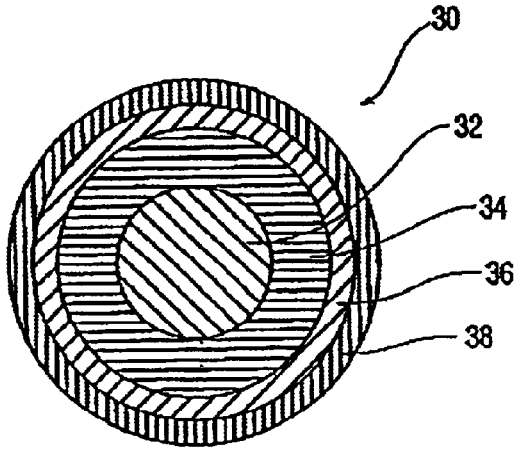
FIG. 3 illustrates a four-layer golf ball wherein any or all of the three innermost portions are formulated according to the present invention.

FIG. 3 illustrates a four-layer golf ball 30 produced in accordance with this invention. The center 32 may be solid, hollow, or fluid-filled, and is surrounded by a inner intermediate layer 34. An outer intermediate layer 36 is disposed about the inner intermediate layer 34. The center 32, inner intermediate layer 34, and outer intermediate layer 36 may be made according to the present invention or with conventional materials. If the center is fluid-filled, however, it is preferred that the inner intermediate layer 34 includes a layer surrounding the fluid-filled center, e.g., a flexible enclosure, that is made of materials known to those skilled in the art, and that the outer intermediate layer 36 be made from a composition of this invention. A cover 38 is disposed about the outer intermediate layer 36.

In another embodiment, FIG. 3 may be representative of a four layer golf ball 30 with a center 32, an outer core layer 34 disposed between the center 32 and an inner cover layer 36, and an outer cover layer 38 disposed about the inner cover layer 36. The center 32 and the outer core layer 34 may be made according to the present invention or with conventional materials. The outer cover layer 38 is preferably formed of a castable reactive liquid injection material. The inner cover layer 36 is preferably formed of a harder material than the outer cover layer 38, e.g., ionomer resins.

EXAMPLES

These and other aspects of the present invention may be more fully understood with reference to the following non-limiting examples, which are merely illustrative of the preferred embodiment of the present invention golf ball construction, and are not to be construed as limiting the invention, the scope of which is defined by the appended claims.

Golf ball centers were prepared using the materials shown in Table 1.

TABLE 1

CENTER FORMULATION (approximate weight percent)

| Ingredients | Center |
|---|---|
| 1,4-polybutadiene | 70 |
| Zinc diacrylate | 8.5 |
| VAROX 802-40KE-HP[a] | 0.5 |
| Zinc oxide | 3.5 |
| Barium sulfate | 17.5 |

[a]A di-(2-t-butylisopropylperoxy)-benzene peroxide commercially available from R.T. Vanderbilt of Norwalk, CT.

The center ingredients were compounded on an internal mixer and rolled into cylinders. These cylinders were cut into portions of approximately 18 grams each, and compression molded in a 1.15" cavity for 15 minutes at about 170° C. to provide centers having a diameter of 1.15". The resulting centers were then placed in a tumbler to remove undesired molding flash, and washed to ensure a clean surface.

EXAMPLES 1–4

Comparison of Control to Golf Balls Prepared According to the Invention

Four intermediate layers, also known as intermediate core layers, were made by first premixing HYTRELT® 3078 with polybutadiene in a temperature-controlled mixer, such as a BRAEBENDER PLASTICORDER mixer. The two ingredients were mixed for about 10 minutes at about 95° C. This mixture was combined in an internal mixer with the other ingredients listed below in Table 2 to prepare the four intermediate core layers. Example 1 is a control intermediate core layer prepared with conventional materials, while Examples 2–4 were intermediate core layers prepared according to the invention.

TABLE 2

INTERMEDIATE CORE LAYER FORMULATIONS & PROPERTIES (weight percent)

| Ingredients | Ex. 1 | Ex. 2 | Ex. 3 | Ex. 4 |
|---|---|---|---|---|
| 1,4-polybutadiene | 52 | 50.3 | 52.6 | 53.4 |
| Zinc diacrylate | 24.7 | 23.8 | 25 | 25.4 |
| VAROX 231XL[a] | 0.3 | 0.3 | 0.3 | 0.3 |
| DBDB 60[b] | 0.01 | 0.01 | 0.01 | 0.01 |
| Trans-polyisoprene | 13 | 12.6 | 6.6 | 0 |
| HYTREL ® 3078[c] | 0 | 3.1 | 6.6 | 13.3 |
| Zinc Oxide | 10.1 | 9.9 | 8.9 | 7.6 |
| Core Compression | 65 | 63 | 56 | 41 |
| Core Coeff. of Restitution | 0.787 | 0.781 | 0.773 | 0.756 |
| Shore C Hardness | 84 | 84 | 82 | 81 |
| Shore D Hardness | 56 | 58 | 53 | 52 |

[a]A 1,1-di(t-butylperoxy)-3,3,5-trimethylcyclohexane peroxide commercially available from R.T. Vanderbilt.
[b]A peroxide commercially available from Elastochem of Chardon, OH.
[c]A thermoplastic elastomer commercially available from E.I. Du Pont de Nemours & Co of Wilmington, DE.

The intermediate core layers of Examples 1–4 were disposed about the center formulation of Table I to provide cores. Each intermediate core layer mixture was roll milled at about 80° C. into long cylinders and cut into 15 gram portions, also referred to as preps. The preps were placed into a mold and formed into half-shells. Two half-shells of each intermediate core layer type were then assembled concentrically about a center prepared as discussed above, and the combination was molded for about 15 minutes at about 170° C. The cores thus formed were then treated to obtain the desired core size (1.580"). The cores had the properties shown above in Table 2, with Example 1 being a control conventional core and Examples 2–4 being dual cores prepared according to the invention.

Three-piece golf balls were then formed using the cores described above with a cover composition having about 29 percent very low modulus ionomer ("VLMI") disposed in a conventional manner about each core. Several golf ball properties of balls having these cores are set forth below:

TABLE 3

GOLF BALL CHARACTERISTICS

| Characteristics | Ex. 1 | Ex. 2 | Ex. 3 | Ex. 4 |
|---|---|---|---|---|
| Ball Compression | 86 | 83 | 72 | 61 |
| Ball Coeff. of Restitution | 0.798 | 0.792 | 0.78 | 0.78 |
| Ball Velocity (ft/s) | 251.8 | 250.7 | 249.0 | 249.1 |
| 50% Failure[a] | 92 | 134 | 200 | 191 |

[a]Average number of hits for 6 out of 12 balls to fail.

As demonstrated by Tables 2 and 3, golf balls of Examples 2–4 that incorporate the cores prepared according to the invention provide softer feel, good playability, and good durability. Additionally, golf balls prepared according to present invention can provide superior durability compared to conventional balls that do not include the compositions of the invention.

EXAMPLE 5

A golf ball according to the present invention may have a center as described in Table 1, an outer core layer as in Table 2, Examples 2–4, an inner cover layer of SURLYN® having a thickness of about 0.035 inches injection molded about the outer core layer in thickness, and an outer cover layer of a cast thermoset polyurethane having a thickness of about 0.03 inches disposed about the inner cover layer. Adhesion between the inner and outer cover layers may be enhanced by additional steps therebetween. The outer cover layer material may contain light stabilization additives.

EXAMPLE 6

A golf ball according to the present invention may have a center as described in Table I, an outer core layer as in Table 2, Examples 2–4, an intermediate layer of polybutadiene, an inner cover layer of non-ionomeric material having a thickness of about 0.035 inches molded about the outer core layer, and an outer cover layer of a cast thermoset polyurethane having a thickness of about 0.03 inches disposed about the inner cover layer.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A golf ball comprising:

a core, wherein the core comprises at least one layer formed of a composition comprising at least one rubber, a metal salt of an α,β-unsaturated carboxylic acid, an initiator, and at least one thermoplastic material having a Vicat-softening temperature of at least about 38° C. selected from the group consisting of a copoly (ether-ester), copoly(ether-amide), copoly(ester-amide), copoly(urethane-ether), copoly(urethane-ester), maleic anhydride grafted styrene-ethylene-butylene-styrene copolymers, and mixtures thereof; and an inner cover disposed about the core; and an outer cover disposed about the inner cover.

2. The golf ball of claim 1, wherein the at least one thermoplastic material has at least one of a hardness of at least about 15 Shore A, a dynamic storage modulus of at least about $10^4$ dynes/cm$^2$, or a loss tangent no greater than 1 at 23° C. and a frequency of 1 Hz.

3. The golf ball of claim 1, wherein the amount of the at least one thermoplastic material is from about 1 to 50 parts per hundred of the total parts of the rubber.

4. The golf ball of claim 1, wherein the at least one rubber is selected from the group consisting of polybutadiene, polyisoprene, ethylene-propylene, styrene-butadiene, ethylene-propylene-diene rubber, a polymer of ethylene-propylene diene monomer, styrene-ethylene-butylene-styrene copolymer, and mixtures thereof, including functionalized derivatives thereof.

5. The golf ball of claim 1, wherein the core has a diameter of about 1.55 inches or less.

6. The golf ball of claim 1, wherein the outer cover comprises a castable reactive liquid material.

7. The golf ball of claim 6, wherein the castable reactive liquid material is cast polyurethane.

8. The golf ball of claim 1, wherein the outer cover has a hardness from about 30 Shore D to about 60 Shore D.

9. The golf ball of claim 1, wherein the outer cover has a thickness from about 0.02 inches to about 0.045 inches.

10. The golf ball of claim 1, wherein the inner cover comprises at least one material selected from the group consisting of ionomers, thermoplastic or thermoset polyurethanes, polyetheresters, polyetheramides, or polyesters, dynamically vulcanized elastomers, functionalized styrene-butadiene elastomers, metallocene polymers, polyamides, acrylonitrile butadiene-styrene copolymers (ABS), and blends thereof.

11. The golf ball of claim 10, wherein the inner cover comprises at least one ionomer comprising at least one F/X/Y copolymer, wherein E comprises ethylene, wherein X comprises a softening comonomer, and wherein Y comprises at least one acrylic or methacrylic acid neutralized to 100 percent.

12. The golf ball of claim 1, wherein the inner cover has a thickness from about 0.01 inches to about 0.05 inches.

13. The golf ball of claim 1, wherein the inner cover has a hardness of about 65 Shore D or greater.

14. A golf ball comprising:

a core comprising at least two layers, wherein at least one of the core layers is formed of a composition comprising at least one rubber, a metal salt of an α,β-unsaturated carboxylic acid, an initiator, and at least one thermoplastic material having a Vicat-softening temperature of at least about 38° C. selected from the group consisting of a copoly(ether-ester),copoly(ether-amide), conoly(ester-amide), copoly(urethane-ether), copoly(urethane-ester), malcic anhydride grafted styrene-ethylene-butylene-styrene copolymers, and mixtures thereof; and an inner cover disposed about the core; and an outer cover disposed about the inner cover.

15. The golf ball of claim 14, wherein the at least one thermoplastic material has at least one of a hardness of at least about 15 Shore A, a dynamic storage modulus of at least about $10^4$ dynes/cm$^2$, or a loss tangent no greater than 1 at 23° C. and a frequency of 1 Hz.

16. The golf ball of claim 14, wherein the amount of the at least one thermoplastic material is from about 1 to 50 parts per hundred of the total parts of the rubber.

17. The golf ball of claim 14, wherein the at least one rubber is selected from the group consisting of polybutadiene, polyisoprene, ethylene-propylene, styrene-butadiene, ethylene-propylene-diene rubber, a polymer of ethylene-propylene diene monomer, styrene-ethylene-butylene-styrene copolymer, and mixtures thereof; including functionalized derivatives thereof.

18. The golf ball of claim 14, wherein the core has a diameter of about 1.55 inches or less.

19. The golf ball of claim 14, wherein the outer cover comprises a castable reactive liquid material.

20. The golf ball of claim 19, wherein the castable reactive liquid material is cast polyurethane.

21. The golf ball of claim 14, wherein the outer cover has a hardness from about 30 Shore D to about 60 Shore D.

22. The golf ball of claim 14, wherein the outer cover has a thickness from about 0.02 inches to about 0.045 inches.

23. The golf ball of claim 14, wherein the inner cover comprises at least one material selected from the group consisting of ionomers, thermoplastic or thermoset polyurethanes, polyetheresters, polyetheramides, or polyesters, dynamically vulcanized elastomers, functionalized styrene-butadiene elastomers, metallocene polymers, polyamides, acrylonitrile butadiene-styrene copolymers (ABS), and blends thereof.

24. The golf ball of claim 23, wherein the ionomer comprises acid moieties neutralized to 100 percent.

25. The golf ball of claim 14, wherein the inner cover has at least one of a hardness of about 65 Shore D or greater.

26. The golf ball of claim 14, wherein the inner cover has a thickness from about 0.01 inches to about 0.05 inches.

27. A method of forming a golf ball comprising:

forming a first mixture comprising at least one rubber and at least one thermoplastic material selected from the group consisting of a copoly(ether-ester), copoly(ether-amide), copoly(ester-amide), copoly(urethane-ether), copoly(urethane-ester), maleic anhydride grafted styrene-ethylene-butylene-styrene copolymers, and mixtures thereof;

mixing said first mixture at a first temperature sufficient to allow substantially homogeneous mixing of said first mixture;

cooling said first mixture to a second temperature;

forming a second mixture by adding the first mixture to a free-radical initiator having an activation temperature at a temperature above the second temperature;

shaping and heating the second mixture to at least the activation temperature to crosslink the second mixture so as to form a portion of a golf ball core;

forming an inner cover disposed about the golf ball core; and forming an outer cover thereon.

28. The method of claim 27, wherein the step of forming an outer cover comprises the step of:

casting a polyurethane about the inner cover.

29. The method of claim 27, further comprising the step of:

forming an outer core layer disposed between the core and the inner cover.

* * * * *